US005471204A

United States Patent [19]

Kudoh et al.

[11] Patent Number: 5,471,204

[45] Date of Patent: Nov. 28, 1995

[54] RADIO COMMUNICATION APPARATUS CAPABLE OF NOTIFYING RECEPTION OF A CALL SIGNAL IN A PERCEPTUAL MODE DETERMINED BY COUNTING A NUMBER OF TIMES OF THE RECEPTION

[75] Inventors: Kazuhiro Kudoh; Akira Muramatsu; Tetsumi Ishiguro, all of Tokyo, Japan

[73] Assignee: NEC Corporation, Tokyo, Japan

[21] Appl. No.: 180,810

[22] Filed: Jan. 10, 1994

Related U.S. Application Data

[63] Continuation of Ser. No. 782,768, Oct. 28, 1991, abandoned, which is a continuation of Ser. No. 419,360, Oct. 10, 1989, abandoned, which is a continuation-in-part of Ser. No. 335,349, Apr. 10, 1989, abandoned.

[30] Foreign Application Priority Data

| | | | |
|---|---|---|---|
| Apr. 9, 1988 | [JP] | Japan | 63-86279 |
| Oct. 12, 1988 | [JP] | Japan | 63-256251 |

[51] Int. Cl.[6] ..... G08B 7/00

[52] U.S. Cl. ..... 340/825.44; 340/825.48

[58] Field of Search ..... 340/825.44, 825.46, 340/825.48, 311.1, 328, 384 E; 455/38.1, 38.2, 38.4, 200.1

[56] References Cited

U.S. PATENT DOCUMENTS

| | | | |
|---|---|---|---|
| 4,072,903 | 2/1978 | Harris | 340/825.44 |
| 4,145,684 | 3/1979 | Stodolski | 340/825.48 |
| 4,237,448 | 12/1980 | Weinberg | 340/825.44 |
| 4,249,165 | 2/1981 | Mori | 340/825.44 |
| 4,385,295 | 5/1983 | Willard et al. | 340/825.44 |
| 4,499,567 | 2/1985 | Armstrong | 340/825.44 |
| 4,682,148 | 7/1987 | Ichikawa et al. | 340/311.1 |
| 4,701,759 | 10/1987 | Nadir et al. | 340/825.44 |
| 4,704,608 | 11/1987 | Sato et al. | 340/825.44 |
| 4,755,816 | 7/1988 | De Luca | 340/825.44 |
| 4,876,536 | 10/1989 | Matai et al. | 340/825.44 |

FOREIGN PATENT DOCUMENTS

| | | | |
|---|---|---|---|
| 55-61315 | 4/1980 | Japan . | |
| 58-43302 | 9/1983 | Japan . | |
| 61-177035 | 8/1986 | Japan . | |
| 2146153 | 4/1985 | United Kingdom | 340/825.44 |

OTHER PUBLICATIONS

PMR2000: Personal Message Receiver, Motorola Inc., © 1986.

Memo–Page I, "Telocator Magazine" Mar. 1984.

*Primary Examiner*—Donald J. Yusko

*Assistant Examiner*—Edwin C. Holloway, III

*Attorney, Agent, or Firm*—Sughrue, Mion, Zinn, Macpeak & Seas

[57] ABSTRACT

In a radio communication apparatus for use in carrying out a receiving operation of selectively receiving a call signal specific to the apparatus, a counter is counted up one by one to produce a count each time when the call signal is received. The count is successively compared with a plurality of threshold values by a control section to determine a controllable perceptual notifying mode which may be at least one of an audible and a visual notifying modes. In the audible notifying mode, the control section varies a volume of an audible tone through a tone generator in dependency upon the count. In the visual notifying mode, display elements, such as light emitting diodes, provide visual displays which are different from one another and which are determined by the count. Such variations of the audible tone and/or the visual displays are helpful for notifying a possessor of reception of the call signal.

13 Claims, 7 Drawing Sheets

RADIO COMMUNICATION APPARATUS CAPABLE OF NOTIFYING RECEPTION OF A CALL SIGNAL IN A PERCEPTUAL MODE DETERMINED BY COUNTING A NUMBER OF TIMES OF THE RECEPTION

This is a Continuation of application Ser. No. 07/782,768 filed Oct. 28, 1991, abandoned which is a Continuation of application Ser. No. 07/419,360 filed Oct. 10, 1989, abandoned which is a Continuation-in-part of application Ser. No. 07/335,349 filed Apr. 10, 1989, now abandoned.

BACKGROUND OF THE INVENTION

This invention relates to a radio communication apparatus or device for use in carrying out an operation in response to a call signal. The radio communication apparatus may be a radio paging receiver, a transceiver, or the like, although description will be mainly directed to the radio paging receiver.

A radio paging receiver of the type described includes a receiving circuit for carrying out a receiving operation of selectively receiving a call signal specific to the apparatus. The receiving circuit produces a received signal whenever the receiving circuit receives the call signal. On production of the received signal, the radio paging receiver perceptually or sensorily gives notice of receiving the call signal too a possessor or user. Such a perceptual or sensory notice may be given in an audible manner and/or in a visible manner.

A wide variety of radio paging receivers are already known which audibly notify the reception of the call signal. By way of example, such a radio paging receiver is disclosed in Japanese Unexamined Utility Model Registration Publication No. Syô 55-61,315, namely, 61,315/1980. The radio paging receiver disclosed in the above-mentioned publication comprises a volume mode switch for producing a volume mode signal indicative of one of some kinds of volume and a control circuit for making the tone generator generate the audible tone in the volume indicated by the volume mode signal, each time on reception of a call signal. Thus, the audible tone is generated regardless of reception times of the call signals.

Other similar radio paging receivers are also disclosed in U.S. Pat. No. 4,237,448 and in Japanese Utility Model Registration Publication No. Syô 58-43,302 (43,302/1983). In each of the receivers, an audible tone is generated in a volume which is gradually grown, each time when a call signal is received. Such a growing audible tone itself is invariable even when the call signal is repeatedly received many times.

Still another radio paging receiver is revealed in Japanese Unexamined Patent Publication No. Syô 61-177,035 (177,035/1986). The radio paging receiver comprises a light emitting diode (LED) for emitting visible light and a control circuit responsive to the call signal for making the light emitting diode intermittently emit the visible light without generation of the audible tone when the receiver is put into a silent mode. Thus, the radio paging receiver visually notifies reception of the call signal each time when the call signal is received. In other words, visual displays are provided so as to visually notify the reception of the call signal.

At any rate, each of such conventional radio paging receivers audibly or visually notifies reception of the call signal in the manner determined for each radio paging receiver. However, such audible or visual notification in each radio paging receiver never depends on reception times of the call signal. In other words, even when the call is repeatedly received many times and is very urgent and important, the possessor can not recognize such urgency or importance of the call signal.

SUMMARY OF THE INVENTION

It is an object of this invention to provide a radio communication apparatus which is capable of notifying reception of a call signal in consideration of urgency or importance of the call signal.

It is another object of this invention to provide a radio communication apparatus of the type described, which can generate an audible tone in dependency upon the urgency or importance.

It is still another object of this invention to provide a radio communication apparatus of the type described, which can visually display reception of the call signal in dependency upon the call signal.

A radio communication apparatus to which this invention is applicable includes receiving means for carrying out a receiving operation of selectively receiving a call signal specific to the apparatus. The receiving means produces a received signal whenever the receiving means receives the call signal. According to this invention, the apparatus comprises counting means connected to the receiving means and given an initial count for counting up the initial count to an increased count one by one in response to the received signal to produce a count signal representative of the increased count, notifying means for giving notice of receiving the call signal with a controllable perceptual notifying mode, and controlling means connected to the counting means and the notifying means for controlling the controllable perceptual notifying mode in response to the count signal.

DESCRIPTION OF THE PREFERRED EMBODIMENTS

Figure 1:
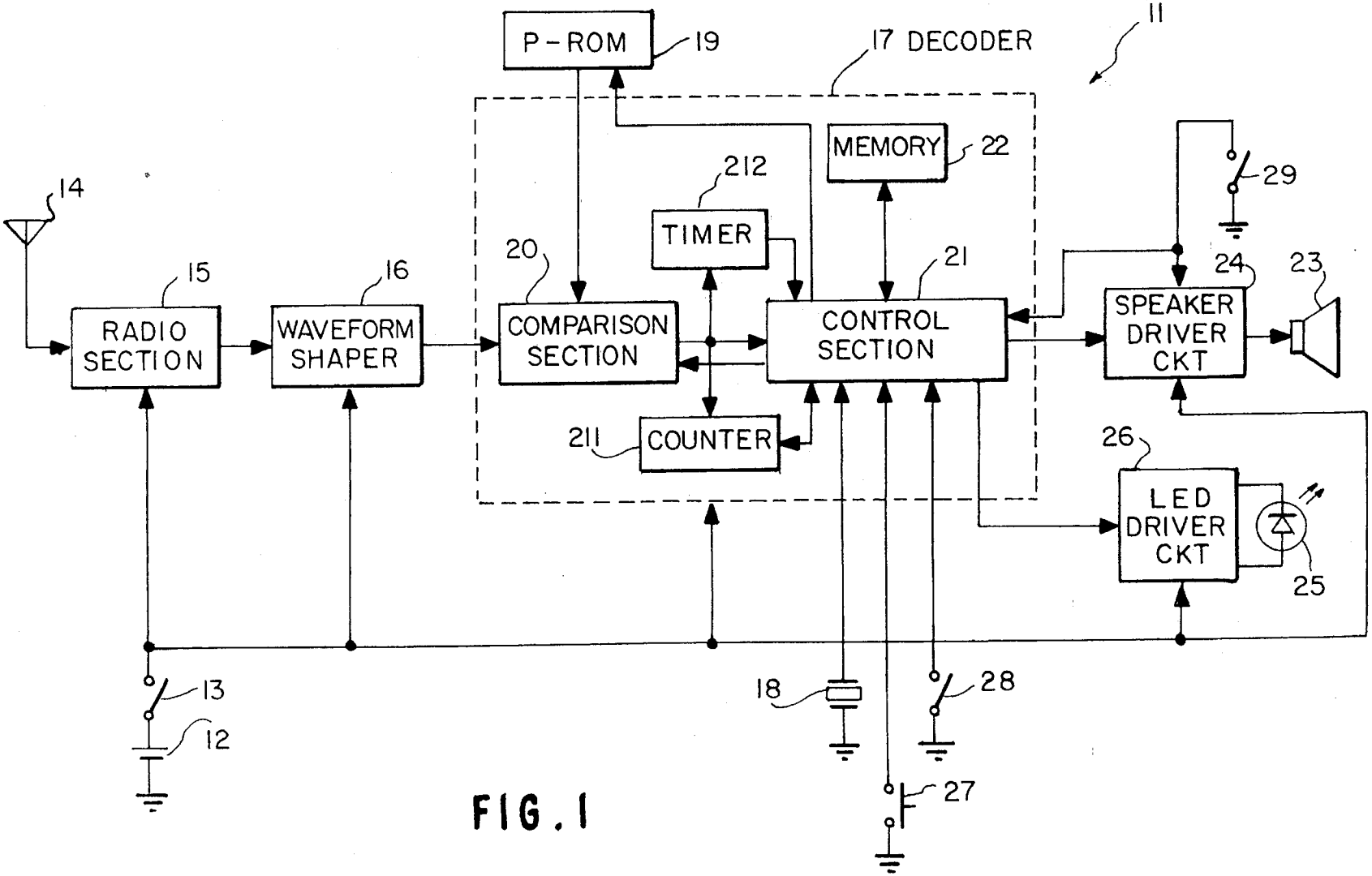
FIG. 1 is a block diagram of a radio paging receiver according to a first embodiment of this invention.

Referring to FIG. 1, a radio paging receiver 11 according to a first embodiment of this invention is for receiving a call signal indicative of a call number. The call signal is transmitted as a radio signal from a transmitting station (not shown).

The radio paging receiver 11 is for use in combination with a battery 12 for generating electric power. The radio paging receiver 11 is connected to the battery 12 through a manually operable power source switch 13 and activated by the electric power when the power source switch 13 is closed to an on state.

The radio signal is picked up by an antenna 14 and supplied to a radio section 15. When the radio section 15 is activated by the electric power supplied from the battery 12 through the switch 13, the radio section 15 converts or demodulates the radio signal into a baseband or demodulated signal. The demodulated signal is supplied to a waveform shaper 16. The waveform shaper 16 is also activated by the electric power and shapes a waveform of the demodulated signal into a shaped signal of a digital waveform. The shaped signal is supplied to a decoder 17.

When the decoder 17 is activated by the electric power, the decoder 17 cooperates with a quartz crystal oscillator 18 and a P-ROM (programmable read-only memory) 19 in the manner which will be described as the description proceeds.

The decoder 17 comprises a comparison section 20 for comparing, under the control of a control section 21, the call number indicated by the shaped signal with a directory number specific to the radio paging receiver 11 that is memorized in the P-ROM 19. The comparison section 20 produces a received signal when the call number coincides with the directory number. Thus, the comparison section 20 serves, in combination with the P-ROM 19, as a receiving circuit. The call signal may have not only the call number but also a message. In this case, the comparison section 20 has to compare a combination of the call number and the message with a memorized call number which is already memorized in the P-ROM 19.

The control section 21 is put into operation in synchronism with a clock pulse sequence supplied from the quartz crystal oscillator 18. Responsive to the received signal, the control section 21 produces a tone signal and a light signal in the manner which will later be described.

The control section 21 is connected to a counter 211 and a timer 212. The counter 211 is given an initial count of, for example, zero. Responsive to the received signal, the counter 211 counts up the initial count to an increased count one by one to produce a count signal representative of the increased count. Responsive to the received signal, the timer 212 measures a lapsed time after reception of the received signal. If the timer 212 does not receive a reset signal which will become clear as the description proceeds, the timer 212 produces a time out signal when a predetermined time interval of, for example, about twenty seconds, lapses. Responsive to the time out signal, the control section 21 stores the received signal in a memory 22 as a confirmation waiting call signal.

A loudspeaker 23 is connected to the control section 21 through a speaker driver circuit 24 of, for example, an amplifier activated by the electric power. Responsive to the tone signal, the loudspeaker 20 generates an audible tone in a controllable volume. That is, the loudspeaker 23 serves, in cooperation with the speaker driver circuit 24, as a tone generator for generating the audible tone in the controllable volume.

A light emission diode (LED) 25 is connected to the control section 21 through an LED driver circuit 26 of, for example, another amplifier activated by the electric power. Responsive to the light signal, the light emission diode 25 intermittently emits visible light. That is, the light emission diode 25 is operable, in combination with the LED driver circuit 26, as a light emitting device for emitting the visible light.

A manually operable reset switch 27 is connected to the control section 21 for producing the reset signal when the reset switch 27 is closed to be put into the on state by a possessor of the radio paging receiver 11. The reset signal will become clear as the description proceeds.

In the example being illustrated, the radio paging receiver 11 is selectively operable in one of a normal mode, a quiet volume mode, and a silent mode in the manner which will later be described.

To this end, a silent mode switch 28 is connected to the control section 21 for producing a silent mode signal indicative of silence when the silent mode switch 28 is closed by the possessor. The silent mode signal will become clear as the description proceeds.

A volume mode switch 29 is connected to the control section 21 and the speaker driver circuit 24 for producing a volume mode signal indicative of one of a normal volume and a quiet volume which is smaller than the normal volume. More specifically, the volume mode switch 29 produces the volume mode signal indicative of the normal volume when the volume mode switch 29 is closed to be put into the on state by the possessor. The volume mode switch 29 produces the volume mode signal indicative of the quiet volume when the volume mode switch 29 is opened to an off state by the possessor.

The radio paging receiver 11 is put into the normal mode in response to the volume mode signal indicative of the normal volume when the silent mode switch 28 is opened to the off state by the possessor. In the normal mode, the speaker driver circuit 24 drives the loudspeaker 23 in response to the tone signal so as to usually generate the audible tone in the normal volume. In the normal volume, a sound pressure level is equal to seventy-five decibels when it is measured at a position spaced from the radio paging receiver 11 by thirty centimeters. In addition, the control section 21 may produce the light signal in the normal mode to make the light emitting device intermittently emit the visible light.

The radio paging receiver 11 is put into the quiet volume mode in response to the volume mode signal indicative of the quiet volume when the silent mode switch 28 is opened to be put into the off state by the possessor. In the quiet volume mode, the speaker driver circuit 24 drives the loudspeaker 23 in response to the tone signal so as to ordinarily generate the audible tone with the quiet volume which has a sound pressure level lower than that of the normal volume by twenty decibels. In the quiet volume mode, the control section 21 may produce the light signal to make the light emitting device intermittently emit the visible light.

The radio paging receiver 11 is put into the silent mode in response to the silent mode signal. In the silent mode, the control section 21 generally produces the light signal without production of the tone signal in response to the received signal.

Although the radio paging receiver 11 is put into the silent mode, the control section 21 may produce the tone signal in response to the received signal to make the loudspeaker 23 generate the audible tone in the manner which will later be described. Even though the radio paging receiver 11 is put into the quiet volume mode, the control section 21 may produce the tone signal in response to the received signal to make the loudspeaker 23 generate the audible tone with the normal volume in the manner which will later be described. Furthermore, the control section 21 may produce the tone signal in response to the received signal to make the loudspeaker 23 generate the audible tone in a loud volume which has a sound pressure level higher than that of the normal volume by six decibels in the manner which will later be described.

Figure 2:
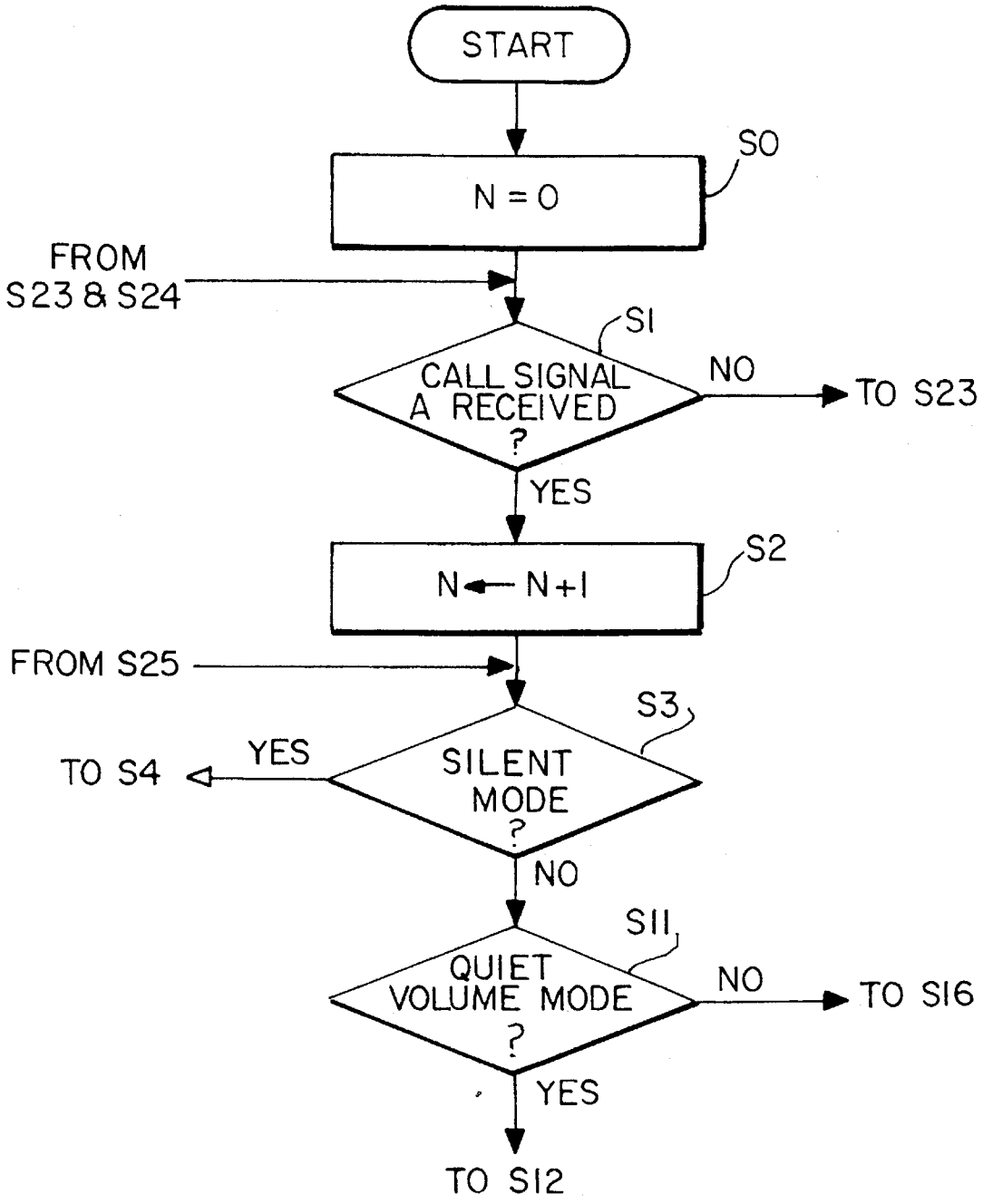
FIGS. 2(*a*), (*b*), and (*c*) collectively show a flow chart for use in describing operation of the radio paging receiver illustrated in FIG. 1.
Figure 2B:
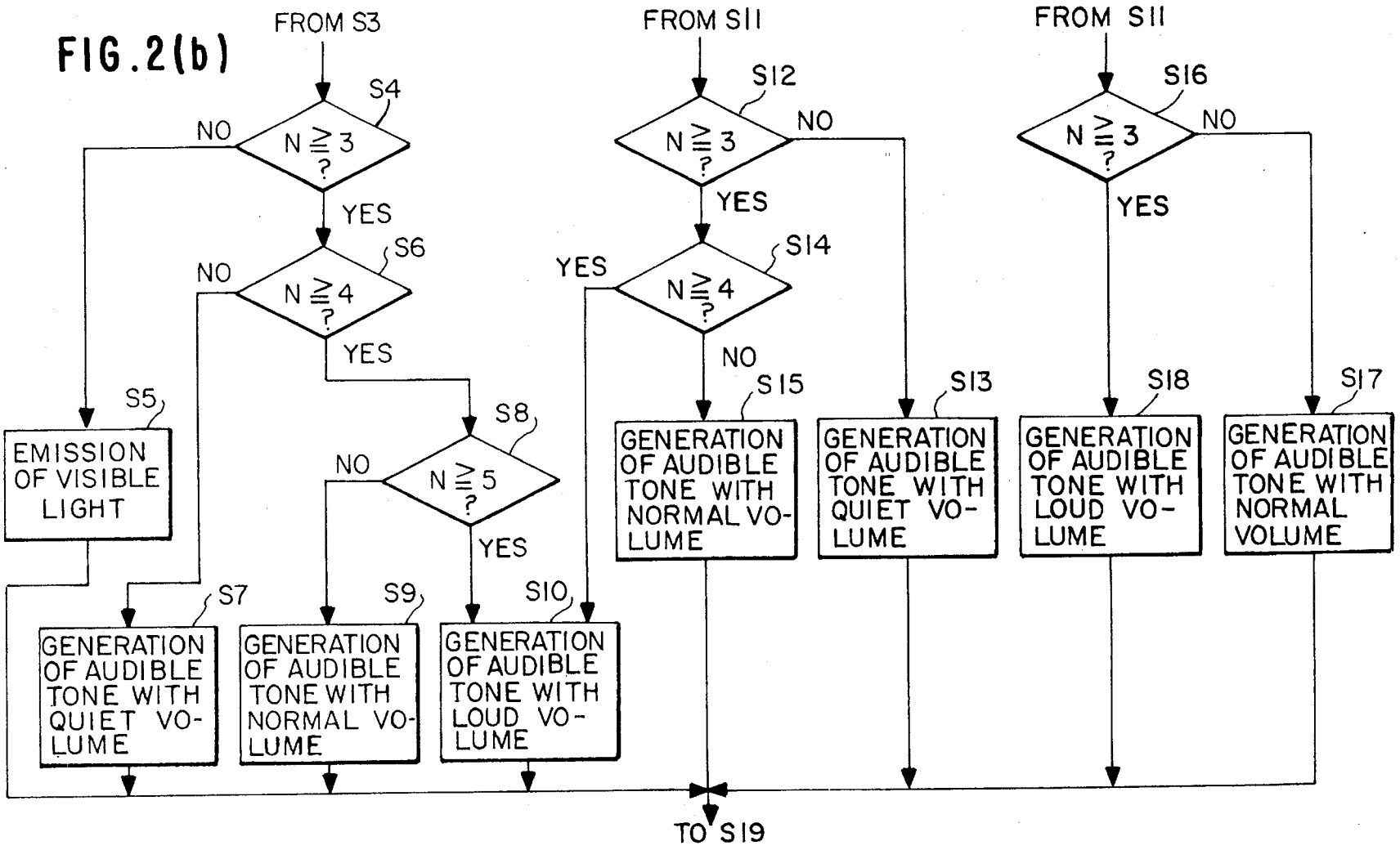
Figure 2:
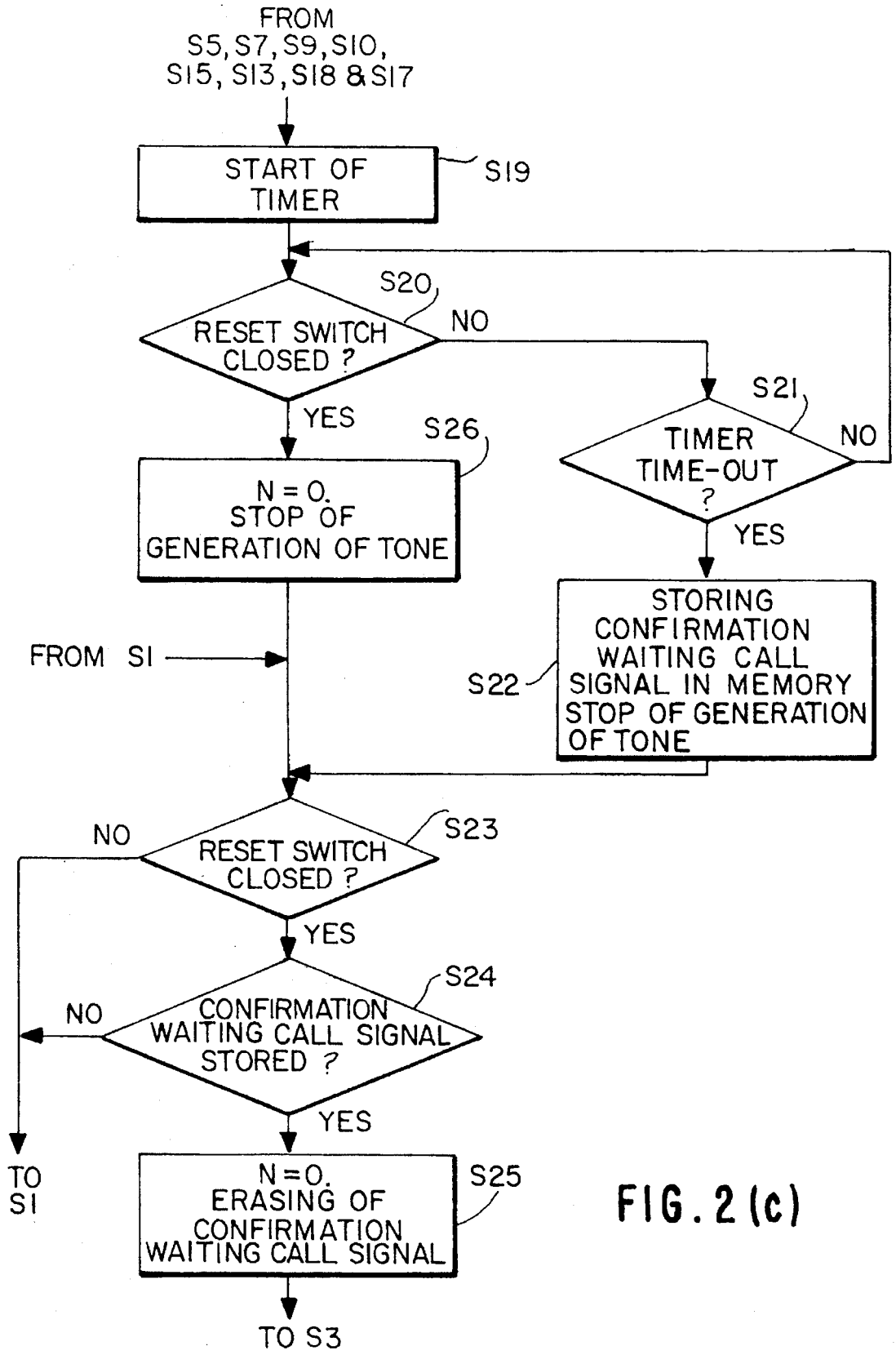

Referring to FIGS. 2(*a*), (*b*), and (*c*), description will proceed to operation of the decoder 17. It will be assumed that the radio paging receiver 11 is assigned with a call number A. A call signal of the call number A will be referred to as a call signal A.

By closure of the switch 13, a count N of the counter 211 is initialized to the initial count of zero at a zeroth stage S0.

When the call signal A is received by the radio paging receiver 11 at a first stage S1, the comparison section 20 produces the received signal in the manner mentioned before. Responsive to the received signal, the counter 211 counts up the count N one by one at a second stage S2.

It will be assumed that the radio paging receiver 11 is put into the silent mode in the manner mentioned before. In this event, the second stage S2 is followed through a third stage S3 by a fourth stage S4 at which the control section 21 judges whether or not the count N is not less than three. When the count N is less than three, the fourth stage S4 is followed by a fifth stage S5 at which the control section 21 produces the light signal to make the light emission diode 25 intermittently emit the visible light while keeping the controllable volume of the audible tone substantially zero. When the count N is equal to three, the fourth stage S4 is followed through a sixth stage S6 by a seventh stage S7 at which the control section 21 produces the tone signal to make the loudspeaker 23 generate the audible tone in the quiet volume. When the count N is equal to four at the sixth stage S6, the fourth stage S4 is followed through the sixth stage S6 and an eighth stage S8 by a ninth stage S9 at which the control section 21 produces the tone signal to make the loudspeaker 23 generate the audible tone in the normal volume. When the count N is not less than five at the eighth stage S8, the fourth stage S4 is followed through the sixth stage S6 and the eighth stage S8 by a tenth stage S10 at which the control section 21 produces the tone signal to make the loudspeaker 23 generate the audible tone with the loud volume.

It will now be assumed that the radio paging receiver 11 is put into the quiet volume mode in the manner mentioned before. In this event, the second stage S2 is followed through the third stage S3 and an eleventh stage S11 by a twelfth stage S12 at which the control section 21 judges whether or not the count N is not less than three. When the count N is less than three, the twelfth stage S12 is followed by a thirteenth stage S13 at which the control section 21 produces the tone signal to make the loudspeaker 23 generate the audible tone with the quiet volume. When the count N is equal to three at a fourteenth stage S14, the twelfth stage S12 is followed through the fourteenth stage S14 by a fifteenth stage S15 at which the control section 21 produces the tone signal to make the loudspeaker 23 generate the audible tone with normal volume. When the count N is not less than four, the twelfth stage S12 is followed through the fourteenth stage S14 by the tenth stage S10 at which the control section 21 produces the tone signal to make the loudspeaker 23 generate the audible tone again with the loud volume.

It will be assumed that the radio paging receiver 11 is put into the normal mode in the manner mentioned before. In this event, the second stage S2 is followed through the third stage S3 and the eleventh stage S11 by a sixteenth stage S16 at which the control section 21 judges whether or not the count N is not less than three. When the count N is less than three, the sixteenth stage S16 is followed by a seventeenth stage S17 at which the control section 21 produces the tone signal to make the loudspeaker 23 generate the audible tone with the normal volume. When the count N is not less than three, the sixteenth stage S16 is followed by an eighteenth stage S18 at which the control section 21 produces the tone signal to make the loudspeaker 23 generate the audible tone with the loud volume.

Responsive to the received signal, the first stage S1 is followed via the second through the eighteenth stages S1 to S18 by a nineteenth stage S19 at which the control section 21 starts the timer 212. The timer 212 produces the time out signal when the predetermined time interval lapses after reception of the received signal as mentioned before. The predetermined time interval may be about twenty seconds long. The nineteenth stage S19 proceeds to a twentieth stage S20.

At the twentieth stage S20, the control section 21 judges whether or not the reset signal is produced by the reset switch 27. As mentioned above, the reset signal is produced when the reset switch 27 is closed to the on state by the possessor of the radio paging receiver 11. In other words, judgement is carried out at the twentieth stage S20 whether or not the reset switch 27 is closed. When the reset signal is not produced by the reset switch 27, the twentieth stage S20 proceeds to a twenty-first stage S21 at which the control section 21 carries out judgement whether or not the time out signal is produced. When the judgement indicates a negative result, operation returns to the twentieth stage S20. When the judgement indicates an affirmative result, the twenty-first stage S21 is succeeded by a twenty-second stage S22 at which the control section 21 stores the received signal in the memory 22 as the confirmation waiting call signal as mentioned before. Simultaneously, the control section 21 makes the tone generator stop generation of the audible tone.

The twenty-second stage S22 proceeds to a twenty-third stage S23 at which the control section 21 judges whether or not the reset signal is produced by the reset switch 27. When the reset signal is not produced by the reset switch 27, the twenty-third stage S23 returns back to the first stage S1. When the reset signal is produced by the reset switch 27, the twenty-third stage S23 is succeeded by a twenty-fourth stage S24 at which the control section 21 judges whether or not the confirmation waiting call signal is stored in the memory 22. When the uncalled signal is not stored in the memory 22, the twenty-fourth stage S24 returns back to the first stage S1. When the uncalled signal is stored in the memory 22, the twenty-fourth stage S24 proceeds to a twenty-fifth stage S25.

At the twenty-fifth stage S25, the control section 21 initializes the count N in the counter 211 to zero. Thus, the control section 21 acts as an initializing arrangement in the manner indicated at the twenty-fifth stage S25. It will be understood that the initializing arrangement is connected to the reset switch 27 and the counter 211 and initializes the count N in the counter 211 to the initial count in response to the reset signal. Simultaneously, the control section 21 erases the uncalled signal out of the memory 22. The twenty-fifth stage S25 returns back to the third stage S3.

The twentieth stage S20 is succeeded by a twenty-sixth stage S26 when the reset signal is produced. At the twenty-sixth stage S26, the control section 21 initializes the count N in the counter 211 to zero. Thus, the control section 21 serves as the initializing arrangement even at the twenty-sixth stage S26. Simultaneously, the control section 21 makes the tone generator stop generation of the audible tone. The twenty-sixth stage S26 shifts to the twenty-third stage S23.

The decoder 17 which operates in the above-mentioned manner can be readily realized by a microprocessor.

Figure 3:
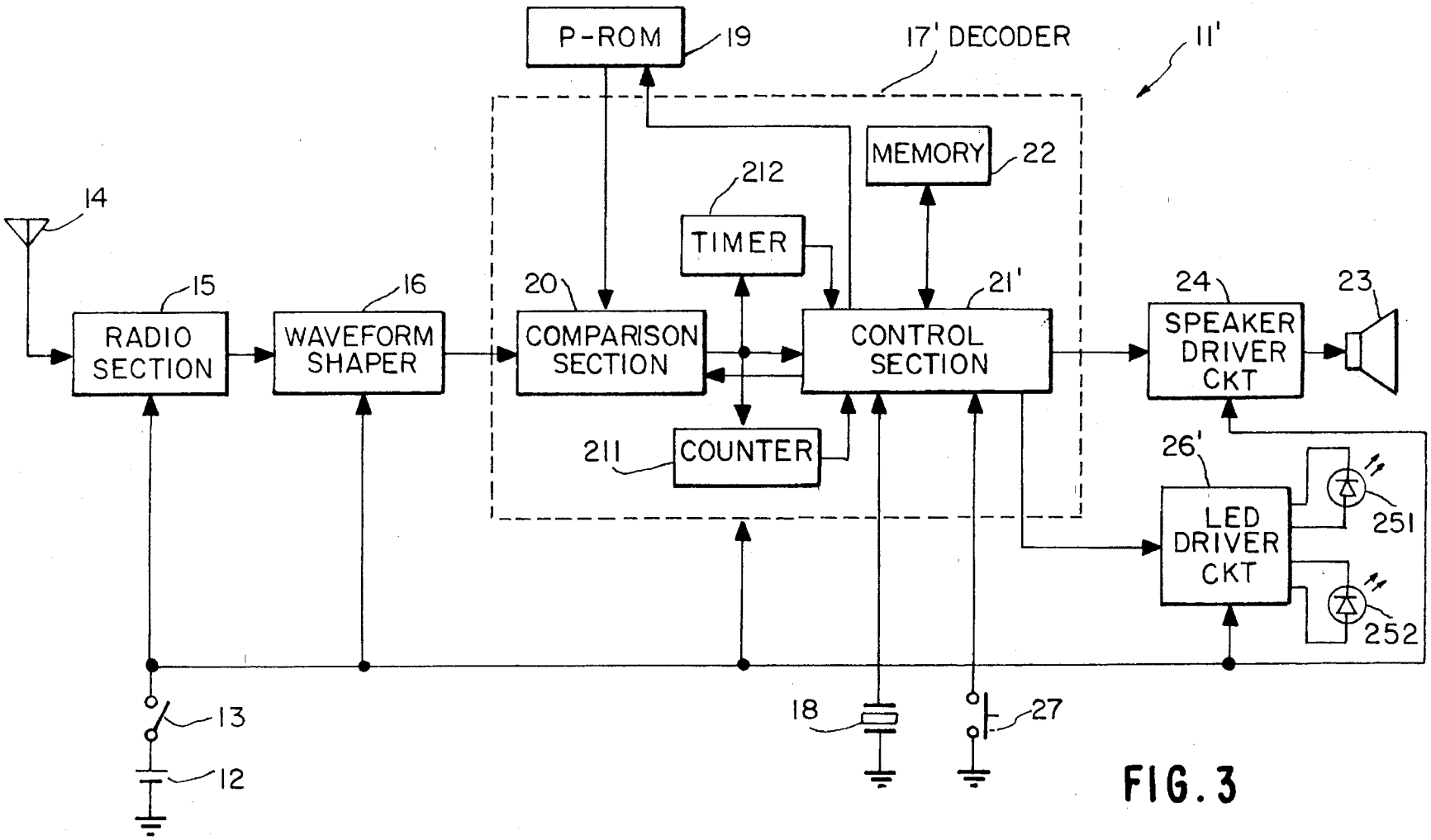
FIG. 3 is a block diagram of a radio paging receiver according to a second embodiment of this invention.

Referring to FIG. 3, a radio paging receiver 11' according to a second embodiment of this invention comprises similar parts designated by like reference numerals. It is to be noted that first and second light emitting diodes (LED) 251 and 252 are connected to an LED driver circuit 26'. In the example being illustrated, the first and the second light emitting diodes 251 and 252 are lit or become luminous in green and red, respectively, when they are enabled by the LED driver circuit 26'. Therefore, the first and the second light emitting diodes 251 and 252 may be referred to as green and red light emitting diodes, respectively. In addition, the LED driver circuit 26' drives the first and the second light emitting diodes 251 and 252 in a controllable visual notifying mode which may be recognized as the controllable perceptual notifying mode. Specifically, the controllable visual notifying mode is selected from first, second, third, fourth, and fifth visual modes. The first and the second visual modes are for causing the first and the second light emitting diodes 251 and 252 to individually flicker, namely, to be intermittently lit, respectively, while the third visual mode is for alternatingly lighting both the first and the second light emitting diodes 251 and 252. Moreover, the fourth and the fifth visual modes are for causing both the first and the second light emitting diodes 251 and 252 to simultaneously flicker and for continuously and simultaneously lighting the first and the second light emitting diodes 251 and 252, respectively.

In order to put the radio paging receiver into the controllable visual notifying mode which is a selected one of the first through the fifth visual modes mentioned above, the illustrated LED driver circuit 26' is controlled by a control section 21' which is somewhat different from the control section 21 illustrated in FIG. 1 and which is operable in a manner to be described later. At any rate, a combination of the LED driver circuit 26' and the first and the second light emitting diodes 251 and 252 serves to visually notify reception of a call signal and may be referred to as a notifying circuit for giving notice.

It is to be noted that the illustrated control section 21' carries out no judgement among the silent mode, the quiet volume mode, and the normal mode illustrated in FIG. 2, although one of the above-mentioned visual modes is selected as the controllable visual notifying mode. In this connection, the silent mode switch 28 and the volume mode signal switch 29 (FIG. 1) are removed from FIG. 3.

Figure 4A:
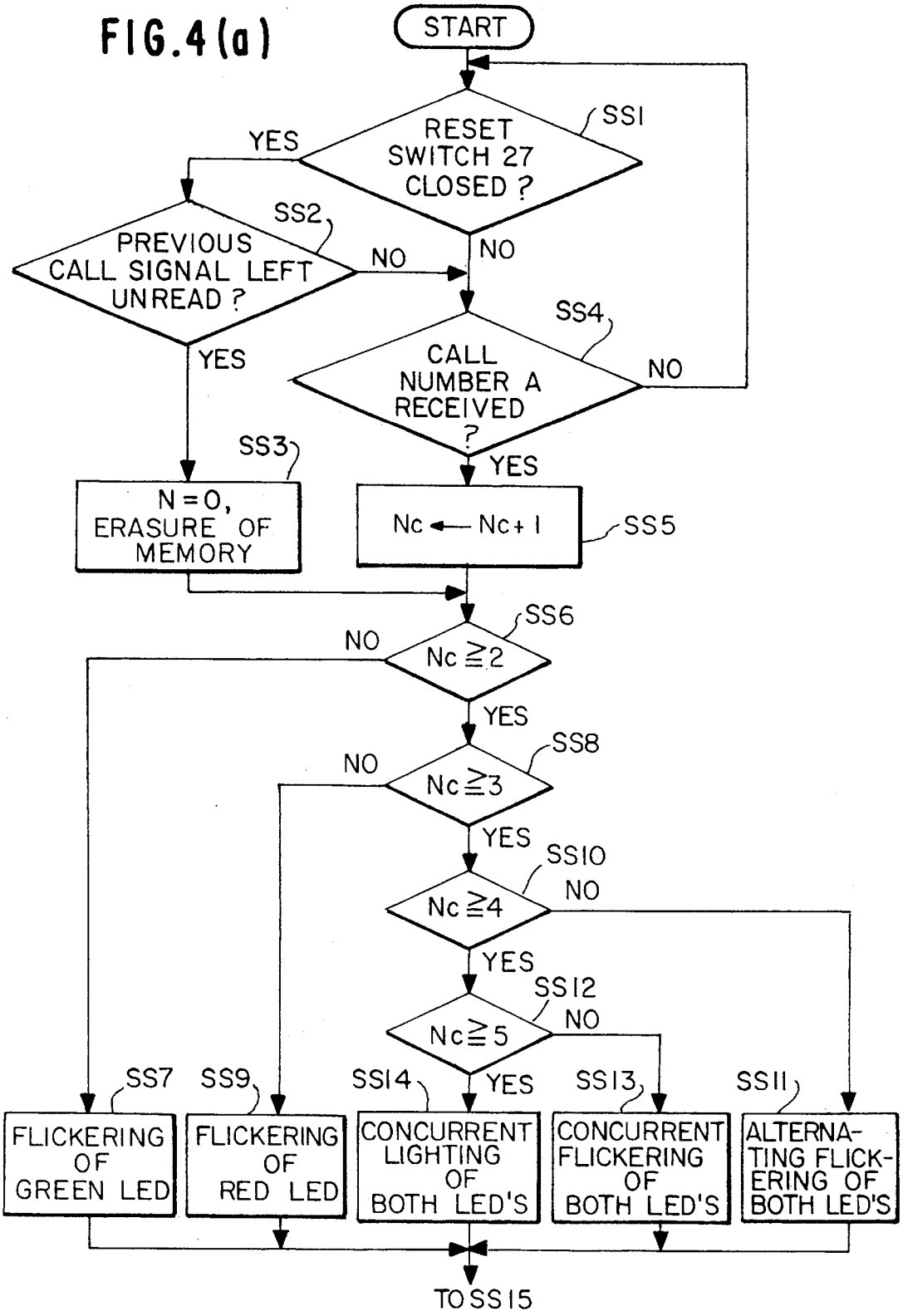
FIGS. 4(*a*) and (*b*) show flow charts for use in describing operation of the radio paging receiver illustrated in FIG. 3.
Figure 4B:
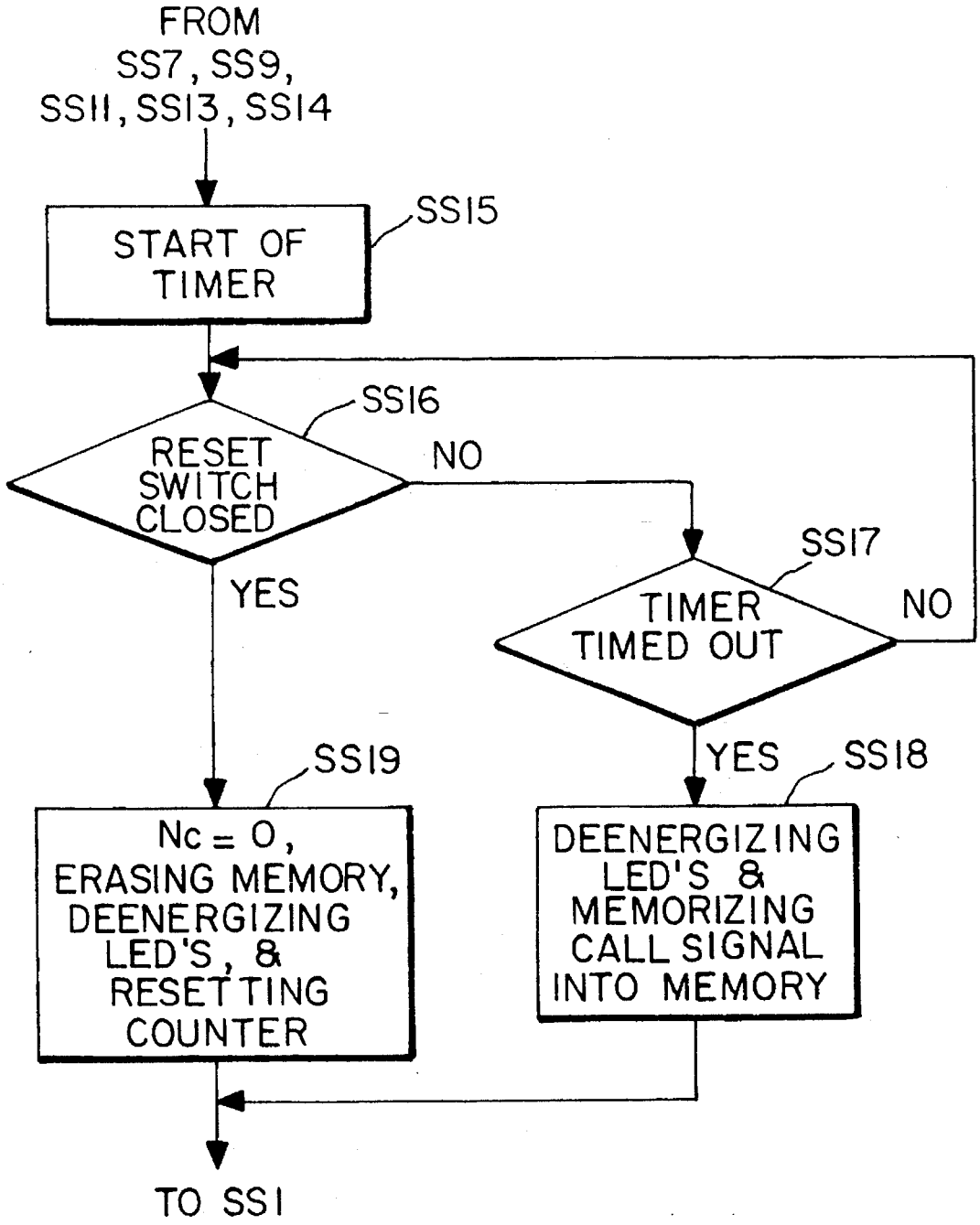

Referring to FIGS. 4(*a*) and (*b*) together with FIG. 3, a radio signal is received as a call signal from the antenna 14 through the radio section 15 and the waveform shaper 16 to the decoder 17 in the form of a sequence of shaped digital signals, like in FIG. 1 when the power switch 13 is closed to energize the illustrated radio paging receiver 11'. In the decoder 17', the shaped digital signals are sent to the comparison section 20 connected to the P-ROM 19. As a result, a call number indicated by the shaped digital signals is compared with a directory number assigned to the radio paging receiver 11' in the manner mentioned in conjunction with FIG. 1. When the call number is coincident with the directory number, the comparison section 20 sends a received signal to the control section 21', the counter 211, and the timer 212 under control of the control section 21', like in FIG. 1. Anyway, a combination of the comparison section 20 and the P-ROM 19 may be called a receiving circuit for receiving a call signal which conveys a message in addition to the call number.

In FIG. 4(*a*), let the decoder 17 be assigned with a call number A and be energized by closure of the source switch 13. Under the circumstances, the decoder 17 starts a reception operation with the count Nc of the counter 211 kept at an initial state of zero. The count Nc is representative of a number of times of receiving the call signal. The times of receiving the call signal may be called reception times hereinunder. At a first step SS1, the control section 21' monitors whether or not the reset switch 27 is closed. On closure of the reset switch 27, the first step SS1 proceeds to a second step SS2 of judging whether or not a previous call signal is left in the memory 22 connected to the control section 21' without being accessed or read out.

When the control section 21' detects at the second step SS2 that the previous call signal is left unread in the memory 22, a third step SS3 succeeds the second step SS2 to read the previous call signal out of the memory 22. After the readout of the previous call signal, the count Nc of the counter 211 is reset into the initial state of zero and the previous call signal is erased from the memory 22, as shown in FIG. 4.

On the other hand, when the reset switch 27 is kept open at the first step SS1 or when no previous call signal is left unread in the memory 22, the control section 21' carries out a fourth step SS4 to detect whether or not the call number A in question is received. If the call number A is received, the fourth step SS4 is followed by a fifth step SS5 at which the count Nc is counted up by one and is charged to (Nc+1). Otherwise, the fourth step SS4 is succeeded by the first step SS1 to wait for the call signal in the above-mentioned manner. Herein, it is mentioned that the count Nc of the counter 211 indicates reception times of the call number A and is sent from the counter 211 to the comparison section 20 as a count signal.

Now, let the third or the fifth step SS3 or SS5 be executed by the control section 21'. In this event, the count Nc of the counter 211 is successively compared by the control section 21' with first through fourth threshold levels or values which may be equal to two, three, four, and five, respectively, and which are successively read out of the memory 22. Each of the first through fourth threshold values is sent from the memory 22 to the control section 21' in the form of a selected threshold signal. Accordingly, the memory 22 is operable to produce the selected threshold signal and may be called a threshold signal producing circuit.

Specifically, the count Nc is compared at a sixth step SS6 with the first threshold value of two. If the count Nc is smaller than two, the sixth step SS6 proceeds to a seventh step SS7 at which the control section 21' controls the LED driver circuit 26' to cause the first or green light emitting diode 251 to flicker in green. Thus, the control section 21' puts the notifying circuit into the first normal mode in which the green light emitting diode 251 alone flickers to notify reception of the call number A one time. To this end, the comparison section 20 produces a comparison signal specifying the first visual mode and delivers the comparison signal to the control section 21'. Responsive to the comparison signal, the control section 21' supplies the LED driver circuit 26' with a mode indication signal which represents the first visual mode.

When the count Nc is equal to or greater than two, the sixth step SS6 is followed by an eighth step SS8 to compare the count Nc with the second threshold value of three. If the count Nc is smaller than three, the eighth step SS8 is succeeded by a ninth step SS9 to cause the second or red light emitting diode 252 to flicker in red. From this fact, it is readily understood that flickering of the red light emitting diode 252 shows that the call number is received two times and that the notifying circuit is put into the second visual mode. Otherwise, a tenth step SS10 is executed after the eighth step SS8 to compare the count Nc with the third threshold value of four and to detect whether or not the count Nc is equal to or greater than the third threshold value of four.

When the control section 21' detects that the count Nc is smaller than four, both the green and the red light emitting diodes 251 and 252 alternatingly flicker under control of the control section 21', as shown at an eleventh step SS11, and are therefore put into the third visual mode. Thus, the third visual mode shows that the call number A is received three times. On the other hand, when the count Nc is equal to or greater than four, the tenth step SS10 is followed by a twelfth step SS12 for detecting whether or not the count Nc is equal to or greater than the fourth threshold value of five.

If the count Nc is smaller than five, the twelfth step SS12 is succeeded by a thirteenth step SS13 to be put into the fourth visual mode in which the green and the red light emitting diodes 251 and 252 are caused to simultaneously flicker by the control section 21'. Such simultaneous flickering of the green and the red light emitting diodes 251 and 252 exhibits that the call number A is repeatedly received four times.

If the count Nc is not smaller than, namely, equal to or greater than five, the twelfth step SS12 is followed by a fourteenth step SS14 to concurrently and continuously light both the green and the red light emitting diodes 251 and 252 without flickering. This shows that the notifying circuit is put into the fifth visual mode. Thus, concurrent lighting of both the green and the red light emitting diodes 251 and 252 shows that the call number A is received five times or more.

As mentioned before, the illustrated control section 21' selects the first through fifth visual modes determined by reception times of the call number A.

Thus, either one of the first through fifth visual modes is selected as the controllable visual notifying mode by the control section 21' in either one of the steps SS7, SS9, SS11, SS13, and SS14.

As shown in FIG. 4(*b*), the control section 21' executes a fifteenth step SS15 at which the timer 212 is enabled to start timing or measuring a predetermined interval of time which may be, for example, 20 seconds. During the predetermined interval, the first and the second light emitting diodes 251 and 252 are put into the controllable visual notifying mode selected by the control section 21'.

After the timer 212 is started, the control section 21' monitors at a sixteenth step SS16 whether or not the reset switch 27 is closed. If the reset switch 27 is not closed by the possessor, the sixteenth step SS16 is succeeded by a seventeenth step SS17 to detect lapse of the predetermined interval. To this end, the timer 212 is monitored by the control section 21'. While the predetermined interval does not lapse, the seventeenth step SS17 is followed by the sixteenth step SS16 to detect whether or not the reset switch 27 is closed. This shows that the controllable visual notifying mode lasts until the reset switch 27 is closed or until the timer 212 is timed out.

When the timer 212 is timed out by lapse of the predetermined interval, the seventeenth step SS17 proceeds to an eighteenth step SS18 at which both the first and the second light emitting diodes 251 and 252 are deenergized to automatically stop the controllable visual notifying mode. It is to be noted that the possessor may not be aware of reception of the call signal when the predetermined interval lapses at the seventeenth step SS17 without closure of the reset switch 27. Taking this into account, the call signal in question is memorized in the memory 22 as an unread call at the eighteenth step SS18.

If the reset switch 27 is closed at the sixteenth step SS16, the control section 21' erases contents of the memory 22 related to the call signal and deenergizes the first and the second light emitting diodes 251 and 252 through the LED driver circuit 26', as illustrated at a nineteenth step SS19. In addition, the counter 211 is reset into the initial state of zero at the nineteenth step SS19. After the eighteenth or the nineteenth steps SS18 or SS19, operation is returned back to the first step SS1.

In the example being illustrated, a tone signal may be generated through the speaker driver circuit 24 and the loudspeaker 23 under control of the control section 21' each time when the call signal is received. Such a tone signal may not be changed, differing from the radio paging receiver 11 illustrated in conjunction with FIGS. 1 and 2.

While this invention has thus far been described in conjunction with a few embodiments thereof, it will readily be possible for those skilled in the art to put this invention into practice in various other manners. For example, three or more light emitting diodes may be used in the radio paging receiver illustrated in FIGS. 3 and 4 to notify reception times of the call signal. In addition, the radio paging receiver may comprise a circuit element for changing both the audible and the visual notifying modes to notify the reception times. A plurality of call numbers may be assigned to a radio paging receiver.

What is claimed is:

1. A radio communication apparatus comprising:

receiving means for receiving call signals, a first number of said call signals being addressed to the radio communication apparatus, each of said first number of call signals being a specific call signal, and a second number of said call signals not addressed to the radio communication apparatus, each of said second number of call signals being other than a specific call signal;

determining means for determining whether or not the received call signal is a specific call signal and for producing a received signal whenever it is determined that the received call signal is a specific call signal;

counting means connected to said receiving means and given an initial count for counting up from said initial count one by one in response to said received signal to produce a reception count signal representative of a reception count of said specific call signal and indicative of the number of times said specific call signal has been received;

audibly notifying means for giving notice of receiving said specific call signal with a perceptually changeable notifying mode which is perceptually changed and which is specified by increasing a volume of an audible tone determined by said reception count of the specific call signal;

a reset switch for manually resetting said audible tone; and controlling means connected to said counting means and responsive to said reception count signal for controlling the volume of said audible tone to vary said volume of the audible tone from one to another in accordance with said reception count represented by said reception count signal to keep the volume of the audible tone constant and to stop the audible tone after lapse of a predetermined duration even when said apparatus is not reset by the reset switch.

2. A radio communication apparatus as claimed in claim 1, further comprising:

initializing means connected to said reset switch and said counting means for initializing the counting means into the initial count when said apparatus is reset by said reset switch.

3. A radio communication apparatus as claimed in claim 1, further comprising light emitting means connected to said controlling means for emitting visible light and a silent mode switch connected to said controlling means for producing a silent mode signal indicative of silence, wherein said controlling means is responsive to said received signal and to said silent mode signal to make said light emitting means emit said visible light while keeping the controllable volume of said audible tone substantially zero if said count is less than a first predetermined count.

4. A radio communication apparatus as claimed in claim 3, wherein said controlling means is responsive to said received signal and to said silent mode signal to make said tone generating means generate the audible tone with a quiet volume if said count is not less than said first predetermined count and is less than a second predetermined count greater than said first predetermined count, said controlling means being responsive to said received signal and to said silent mode signal to make said tone generating means generate the audible tone with a normal volume greater than said quiet volume if said count is not less than said second predetermined count and is less than a third predetermined count greater than said second predetermined count.

5. A radio communication apparatus as claimed in claim 4, wherein said controlling means is responsive to said received signal and to said silent mode signal to make said tone generating means generate the audible tone with a loud volume greater than said normal volume if said count is not less than said third predetermined count.

6. A radio communication apparatus as claimed in claim 1, wherein said controlling means indicates a controllable audible notifying mode as said controllable perceptual notifying mode and comprises means for producing a mode indication signal representative of said controllable audible notifying mode.

7. A radio communication apparatus as claimed in claim 6, wherein said notifying means is supplied with said mode indication signal to be put into said controllable audible notifying mode and comprises:

tine generating means supplied with said mode indication signal for augmenting the audible tone in a controllable volume with an increase of the reception count.

8. A radio communication apparatus as claimed in claim 6, wherein said controlling means is responsive to said received signal to make said tone generating means generate said audible tone in a normal volume when said count is less than a first predetermined count, said controlling means being responsive to said received signal to make said tone generating means generate said audible tone in a loud volume greater than said normal volume when said count is not less than said first predetermined count.

9. A radio communication apparatus as claimed in claim 7, comprising a volume mode switch connected to said controlling means for producing a volume mode signal indicative of one of a normal volume and a quiet volume smaller than said normal volume, wherein said controlling means is responsive to said received signal and to the volume mode signal indicative of said quiet volume to make said tone generating means generate the audible tone in said quiet volume if said count is less than a first predetermined count, said controlling means being responsive to said received signal and to the volume mode signal indicative of said normal volume to make said tone generating means generate the audible tone in said normal mode if said count is not less than said first predetermined count and is less than a second predetermined count greater than said first predetermined count.

10. A radio communication apparatus as claimed in claim 9, wherein said controlling means is responsive to said received signal and to the volume mode signal indicative of said quiet volume to make said tone generating means generate the audible tone in a loud volume greater than said normal volume if said count is not less than said second predetermined count.

11. A radio communication apparatus comprising:

receiving means for receiving call signals, a first number of said call signals being addressed to the radio communication apparatus, each of said first number of call signals being a specific call signal, and a second number of said call signals not addressed to the radio communication apparatus, each of said second number of call signals being other than a specific call signal;

determining means for determining whether or not the received call signal is a specific call signal and for producing a received signal whenever it is determined that the received call signal is a specific call signal;

counting means connected to said determining means and given an initial count for counting up from said initial count one by one in response to said received signal to produce a reception count signal representative of a reception count of said specific call signal and indicative of the number of times said specific call signal has been received;

visibly notifying means for giving visual notices of receiving said specific call signal with a controllable visual notifying mode which is perceptually changed and which is specified by dynamically changing the visual notices from one to another in accordance with said reception count of the specific call signal;

a reset switch for manually resetting said visual notices;

controlling means connected to said counting means and responsive to said reception count signal for controlling the visibly notifying means to dynamically vary the visual notices from one to another in accordance with said reception count represented by said reception count signal and to stop each of the visual notices after lapse of a predetermined duration even when said apparatus is not reset by the reset switch.

12. A radio communication apparatus as claimed in claim 11, wherein said visibly notifying means is supplied with said mode indication signal to be put into said controllable visual notifying mode and comprises:

a first light emitting diode supplied with said mode indication signal for emitting first light of a first color; and a second light emitting diode supplied with said mode indication signal for emitting second light of a second color different from said first color.

13. A radio communication apparatus as claimed in claim 12, said controllable visual notifying mode being selected from first through n-th visual modes different from one another, wherein said controlling means comprises:

threshold signal producing means for producing a selected threshold signal selected from first through n-th threshold signal representative of first through n-th threshold levels which have levels increased in an ascending order and which correspond to said first through said n-th visual modes, respectively;

comparing means supplied with said count signal and said selected threshold signal for successively comparing said count signal with said selected threshold signal to produce a comparison signal specifying a selected one of said first through said n-th visual modes; and signal supplying means for supplying said comparison signal to said visibly notifying means to drive said first and said second light emitting diodes into said selected one of said first through said n-th visual modes and to dynamically vary the visual notices from one to another.

* * * * *